US011158975B2

(12) United States Patent
Hung

(10) Patent No.: US 11,158,975 B2
(45) Date of Patent: Oct. 26, 2021

(54) BASE OF ELECTRICAL CONNECTOR AND ELECTRICAL CONNECTOR

(71) Applicant: Dongguan Luxshare Technologies Co., Ltd, Dongguan (CN)

(72) Inventor: Yung-Chih Hung, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 73 days.

(21) Appl. No.: 16/789,739

(22) Filed: Feb. 13, 2020

(65) Prior Publication Data

US 2021/0126397 A1 Apr. 29, 2021

(30) Foreign Application Priority Data

Oct. 24, 2019 (TW) ..... 108138494

(51) Int. Cl.
*H01R 13/506* (2006.01)
*H01R 13/428* (2006.01)

(52) U.S. Cl.
CPC ..... *H01R 13/506* (2013.01); *H01R 13/428* (2013.01)

(58) Field of Classification Search
CPC ..... H01R 13/506; H01R 13/428
See application file for complete search history.

(56) References Cited

U.S. PATENT DOCUMENTS 5,269,692 A * 12/1993 Takahashi ..... H01R 12/716 439/444
6,165,026 A * 12/2000 Sugie ..... H01R 13/432 439/746
6,302,748 B1 * 10/2001 Xu ..... H01R 13/41 439/751
6,821,160 B2 * 11/2004 Fink ..... H01R 13/512 439/595
6,893,292 B2 * 5/2005 Yamamoto ..... H01R 13/6272 439/595

(Continued)

FOREIGN PATENT DOCUMENTS

CN 2932717 Y 8/2007
TW I634703 B 9/2018
TW I661624 B 6/2019

*Primary Examiner* — Tho D Ta
(74) *Attorney, Agent, or Firm* — Birch, Stewart, Kolasch & Birch, LLP

(57) ABSTRACT

A base of an electrical connector includes a body and a front cover. An installation trough is formed on a first side surface of the body. The body further includes one or more first through holes communicating the installation trough and a second side surface of the body. One or more first positioning members are disposed on an inner wall of the installation trough. The front cover includes a front surface, a rear surface, and one or more second through holes communicating the front and the rear surfaces. One or more second positioning members are disposed on an outer wall of the front cover for combining with the first positioning member. The front cover is embedded into the installation trough with the rear surface facing the body, such that the second positioning member combines with the first positioning member, and the second through hole communicates the first through hole.

19 Claims, 21 Drawing Sheets

(56) References Cited

U.S. PATENT DOCUMENTS

| | | | | |
|---|---|---|---|---|
| 7,354,318 | B2 * | 4/2008 | Murakami | H01R 4/185 439/701 |
| 7,507,118 | B2 * | 3/2009 | Azuma | H01R 13/5221 439/274 |
| 8,469,751 | B2 * | 6/2013 | Oiri | H01R 13/4223 439/701 |
| 9,039,458 | B2 * | 5/2015 | Tsuchiya | H01R 13/4365 439/686 |
| 2009/0081908 | A1 * | 3/2009 | Martin | H01R 13/506 439/752 |
| 2019/0252817 | A1 * | 8/2019 | Kida | H01R 13/506 |
| 2019/0312373 | A1 * | 10/2019 | Nakamura | H01R 13/4364 |

* cited by examiner

BASE OF ELECTRICAL CONNECTOR AND ELECTRICAL CONNECTOR

CROSS-REFERENCE TO RELATED APPLICATION

This non-provisional application claims priority under 35 U.S.C. § 119(a) to patent application No. 108138494 in Taiwan, R.O.C. on Oct. 24, 2019, the entire contents of which are hereby incorporated by reference.

BACKGROUND

Technical Field

This disclosure relates to an electrical connector, in particular, to a base of an electrical connector and the electrical connector.

Related Art

An electrical connector, for example a connector on a circuit board for transmitting power or signals, generally includes an electrical-insulated base and plural terminal pins. The base has plural through holes aligned parallel and defined through the front side surface and the rear side surface of the base. The terminal pins are respectively inserted into the through holes, and elastic latches are exposed from the rear side surface for soldering or electrical connection.

In general, the base of the electrical connector is made by injection molding with plastic materials. As a result, complicated structures for positioning the terminal pins cannot be provided within the through holes. Hence, when the connector is inserted into or detached from a mating connector, the terminal pins suffer the stress for being detached off the connector. To solve the positioning problem for the terminal pins, in an electrical connector known to the inventor, an external fixing pin is inserted into one side surface of the base to hold or stop the terminal pins. However, the external pin is small and cannot be assembled in the electrical connector easily, thereby affecting the production yield of the electrical connector. Moreover, the insertion of the external pin into the electrical connector may cause assembling fail issues, thereby producing defective products.

SUMMARY

In order to solve the positioning problem of the terminal pins in the electrical connector, this disclosure discloses a base of an electrical connector and the electrical connector, in which the terminal pins can be effectively positioned and easily assembled into the base of the electrical connector.

One or more embodiments of this disclosure provide a base of an electrical connector comprising a body and a front cover. The body includes a first side surface and a second side surface. An installation trough is formed on the first side surface, the body further includes at least one first through hole communicating the second side surface and the installation trough, and at least one first positioning member is disposed on an inner wall of the installation trough. The front cover includes a front surface, a rear surface and at least one second through hole communicating the front surface and the rear surface. At least one second positioning member is disposed an outer wall of the front cover for combining with the first positioning member. The front cover is embedded into the installation trough with the rear surface facing the body, such that the at least one second positioning member combines with the at least one first positioning member, and the second through hole communicates the first through hole.

In one or more embodiments, the first positioning member and the second positioning member are a combination of a protruding portion and a recessed portion.

In one or more embodiments, the recessed portion is a trench and the protruding portion is a positioning rib.

In one or more embodiments, the protruding portion is a latch member, and the recessed portion is a latch hole.

In one or more embodiments, the second through hole at one end of the front surface forms a stopping flange, extending inwardly along a radial direction of the second through hole.

In one or more embodiments, the front cover further includes a first guiding bevel located at the front surface of the front cover and corresponding to the second through hole.

In one or more embodiments, the front cover further includes a second guiding bevel located at the rear surface of the front cover and corresponding to the second through hole.

In one or more embodiments, the body further includes a third guiding bevel located at a middle portion of the first through hole, the third guiding bevel divides the first through hole into two sections, a pore diameter of one of the two sections of the first through hole near the second side surface is greater than a pore diameter of the other section of the first through hole near the first side surface.

In one or more embodiments, the front cover includes a plurality of second positioning members respectively disposed on two opposite outer side surfaces of the front cover, and the second positioning members on the two opposite outer side surfaces are arranged in misalignment.

In one or more embodiments, the front cover includes a plurality of second positioning members respectively disposed on two opposite outer side surfaces of the front cover, and a number of the second positioning members on one of the two outer side surfaces of the front cover is different from a number of the second positioning members on the other outer side surface of the front cover.

In one or more embodiments, the front cover includes a plurality of second positioning members respectively disposed on two opposite outer side surfaces of the front cover. Geometrical configurations of the second positioning members on one of the two outer side surfaces of the front cover is different from geometrical configurations of the second positioning members on the other outer side surface of the front cover.

In one or more embodiments, a shape of a cross section of the front cover is axial symmetric or radial symmetric, the front cover includes a plurality of second positioning members, and a center of gravity of the second positioning members does not pass through a centroid of the cross section of the front cover.

In one or more embodiments, a protruding rib is disposed in the second through hole and extending along a longitudinal direction of the second through hole.

In one or more embodiments, the second through holes is connected to the corresponding first through hole to form a terminal insertion hole, a notch is formed in the terminal insertion hole, and the notch is recessed from an inner wall of the terminal insertion hole.

In one or more embodiments, the notch is on an inner wall of the first through hole, on an inner wall of the second through hole, or on a connection portion between the first through hole and the second through hole.

One or more embodiments of this disclosure provide an electrical connector comprising the foregoing base and a terminal pin. The terminal pin includes a pin body received in a terminal insertion hole formed by the first through hole and the second through hole.

In one or more embodiments, a length of the pin body is not greater than a summation of a length of the first through hole and a length of the second through hole.

In one or more embodiments, one side of the pin body is opened to form a concave portion, a protruding rib is disposed in the second through hole and extending along a longitudinal direction of the second through hole, and the protruding rib is received in the concave portion.

In one or more embodiments, a notch is formed in the terminal insertion hole, the notch is recessed from an inner wall of the terminal insertion hole, the terminal pin further includes an elastic latch, the elastic latch is connected to the pin body, and the elastic latch normally protrudes from the pin body and is engaged into the notch.

In one or more embodiments, the notch is on an inner wall of the first through hole, on an inner wall of the second through hole, or on a connection portion between the first through hole and the second through hole.

Based on one or some embodiments of this disclosure, a terminal insertion hole with a relative complicated structure can be formed by the combination of the body and the front cover, thereby facilitating in positioning the terminal pin in the base of the electrical connector without additional fixing elements, such as fixing pins. Accordingly, the assembly procedure for the electrical connector is significantly simplified.

BRIEF DESCRIPTION OF THE DRAWINGS

The present invention will become more fully understood from the detailed description given herein below for illustration only, and thus not limitative of the present invention, wherein.

DETAILED DESCRIPTION

Figure 1:
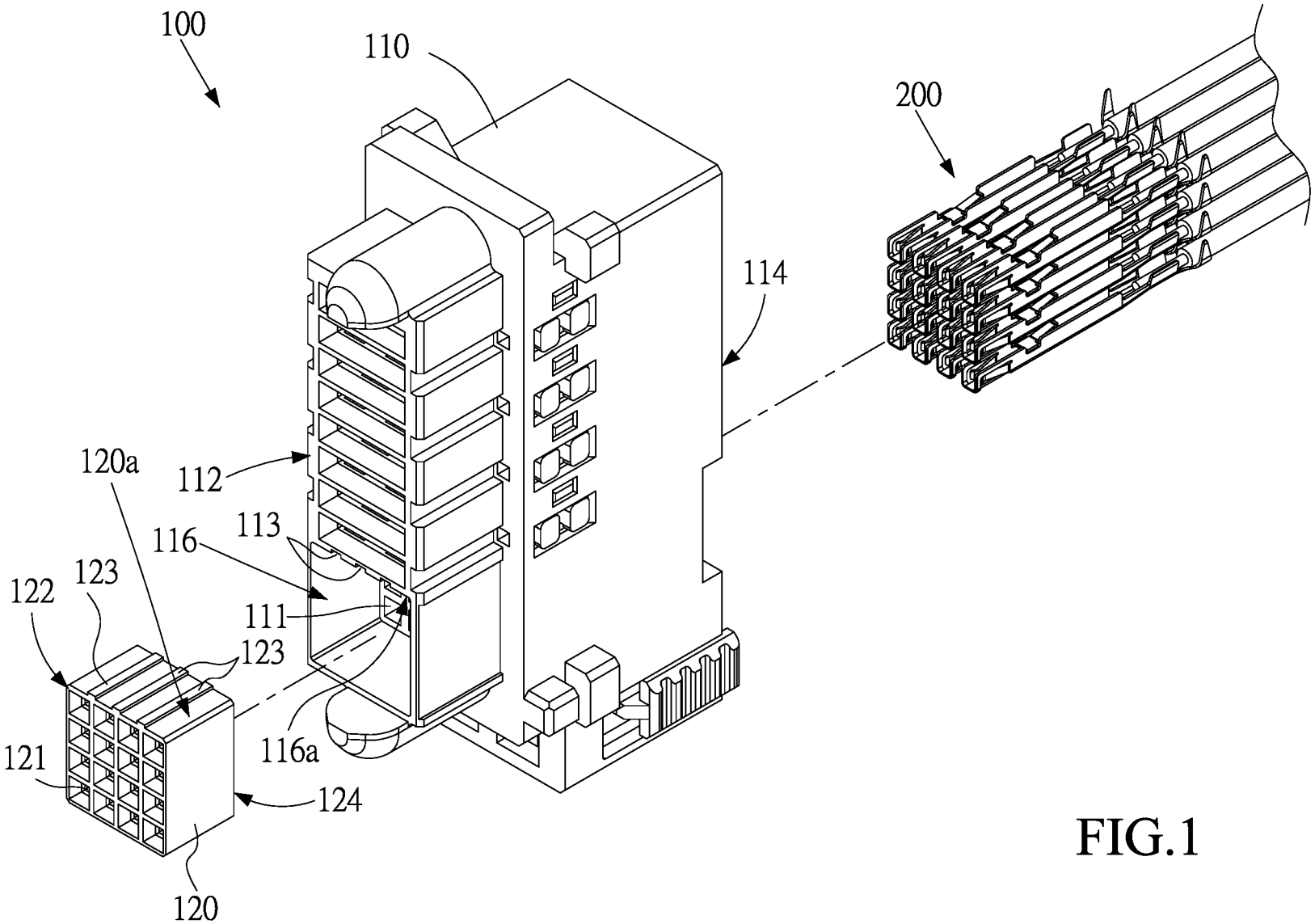
FIG. 1 illustrates an exploded view of an electrical connector according to a first embodiment of this disclosure.
Figure 2:
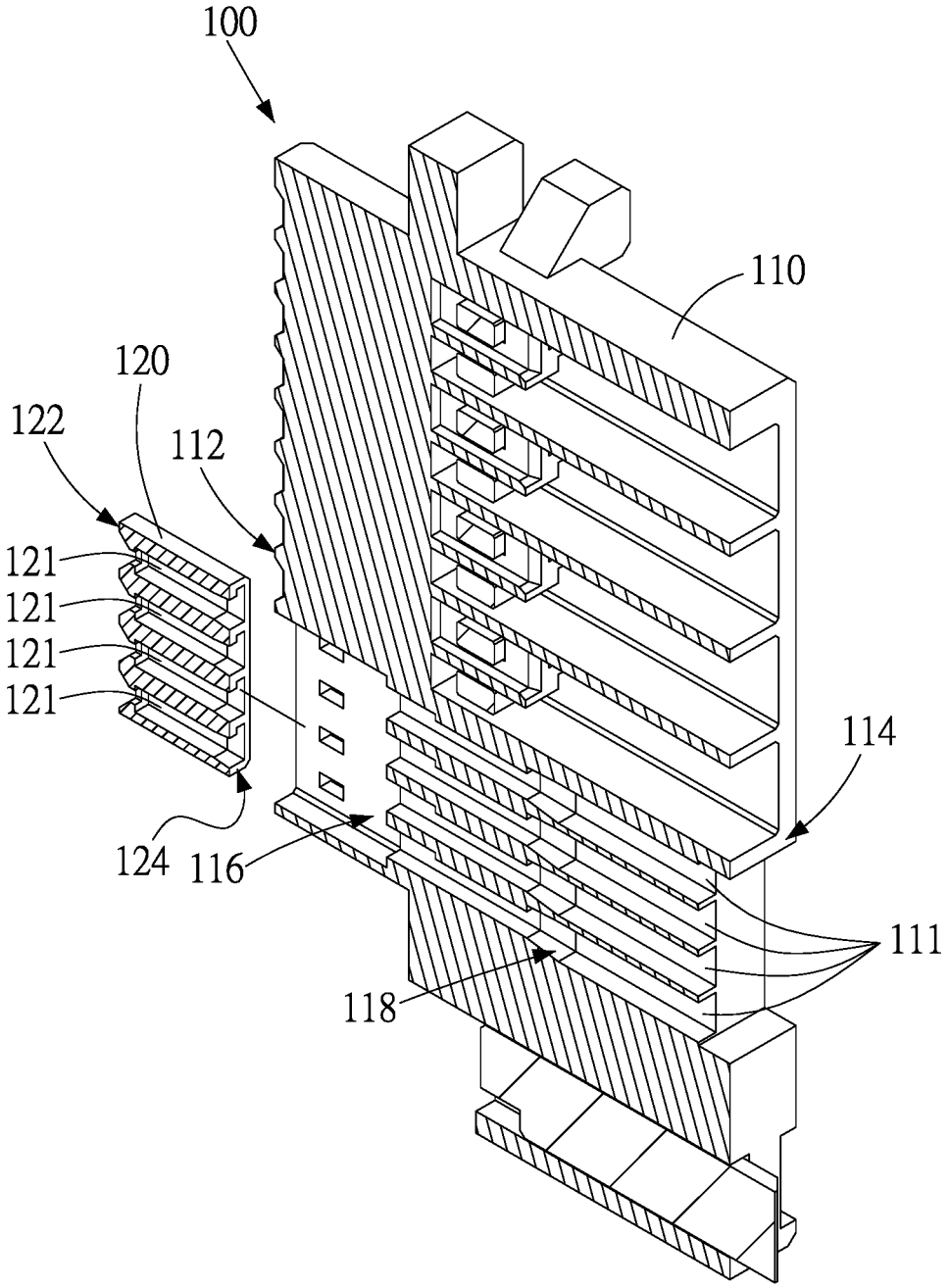
FIG. 2 illustrates an exploded cross-sectional view of a base of the electrical connector of the first embodiment.
Figure 3:
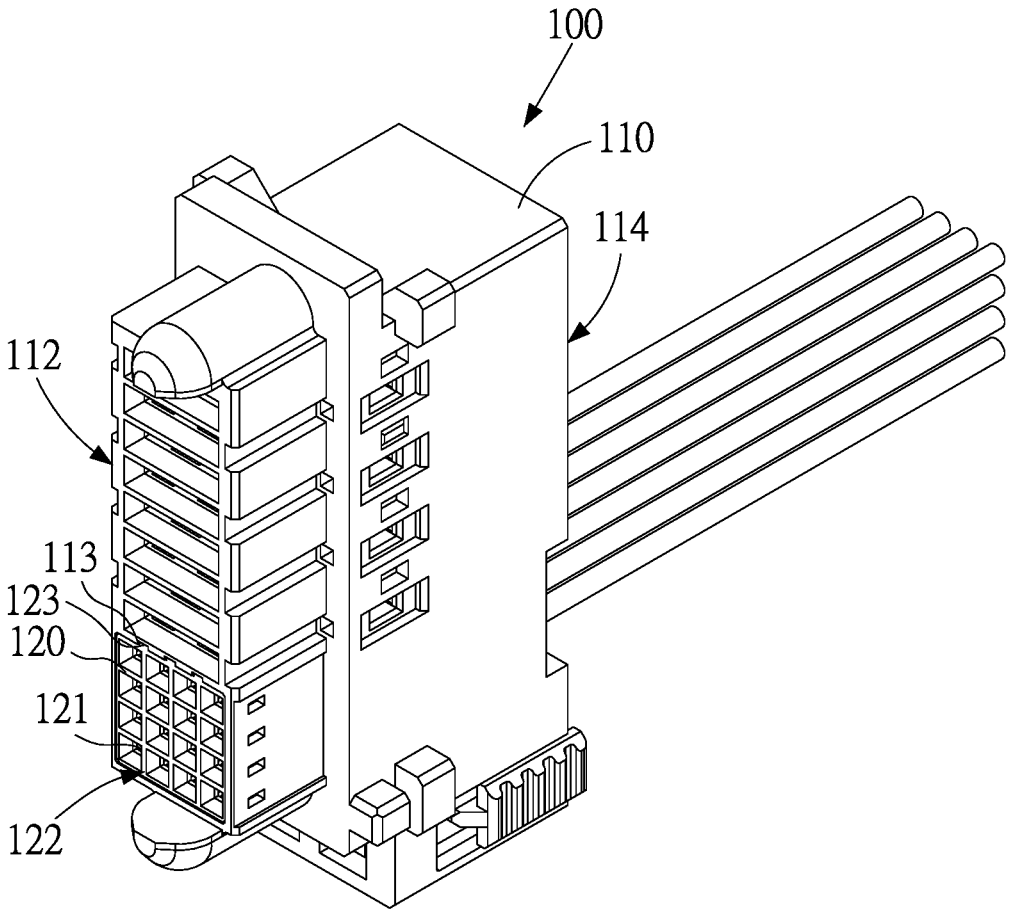
FIG. 3 illustrates a perspective view of the electrical connector of the first embodiment.

Please refer to FIGS. 1, 2, and 3, a base 100 of an electrical connector according to a first embodiment of this disclosure is illustrated. The base 100 is adapted to be combined with at least one terminal pin 200 to form the electrical connector. The base 100 comprises a body 110 and a front cover 120. In general, the body 110 and the front cover 120 are made of electrical-insulated materials. Specifically, in one embodiment, the body 110 and the front cover 120 are made of plastic materials by injection molding techniques.

As shown in FIGS. 1 and 2, the body 110 includes a first side surface 112 and a second side surface 114 opposite to the first side surface 112. An installation trough 116 is formed on the first side surface 112. The installation trough 116 may almost cover the entire first side surface 112, or may just occupy a portion of the first side surface 112. The body 110 further includes one or more first through holes 111. The first through holes 111 are provided for the terminal pins 200 to be inserted thereinto. The first through hole 111 communicates the second side surface 114 and the installation trough 116. One or more first positioning members 113 are disposed on an inner wall **116*a* of the installation trough 116. The inner wall 116*a* may be a single continuous curved surface or may be a surface formed by connecting plural planes. In the first embodiment, plural planes are connected sequentially to form the inner wall 116*a***.

As shown in FIGS. 1 and 2, the front cover 120 includes a front surface 122 and a rear surface 124. The front cover 122 further includes one or more second through holes 121, and the second through holes 121 communicate the front surface 122 and the rear surface 124. At least one second positioning member 123 is disposed on an outer wall **120*a* of the front cover 120. The second positioning member 123 is provided for combining with one of the first positioning members 113, so that the assembly direction of the front cover 120** can be limited.

Figure 4:
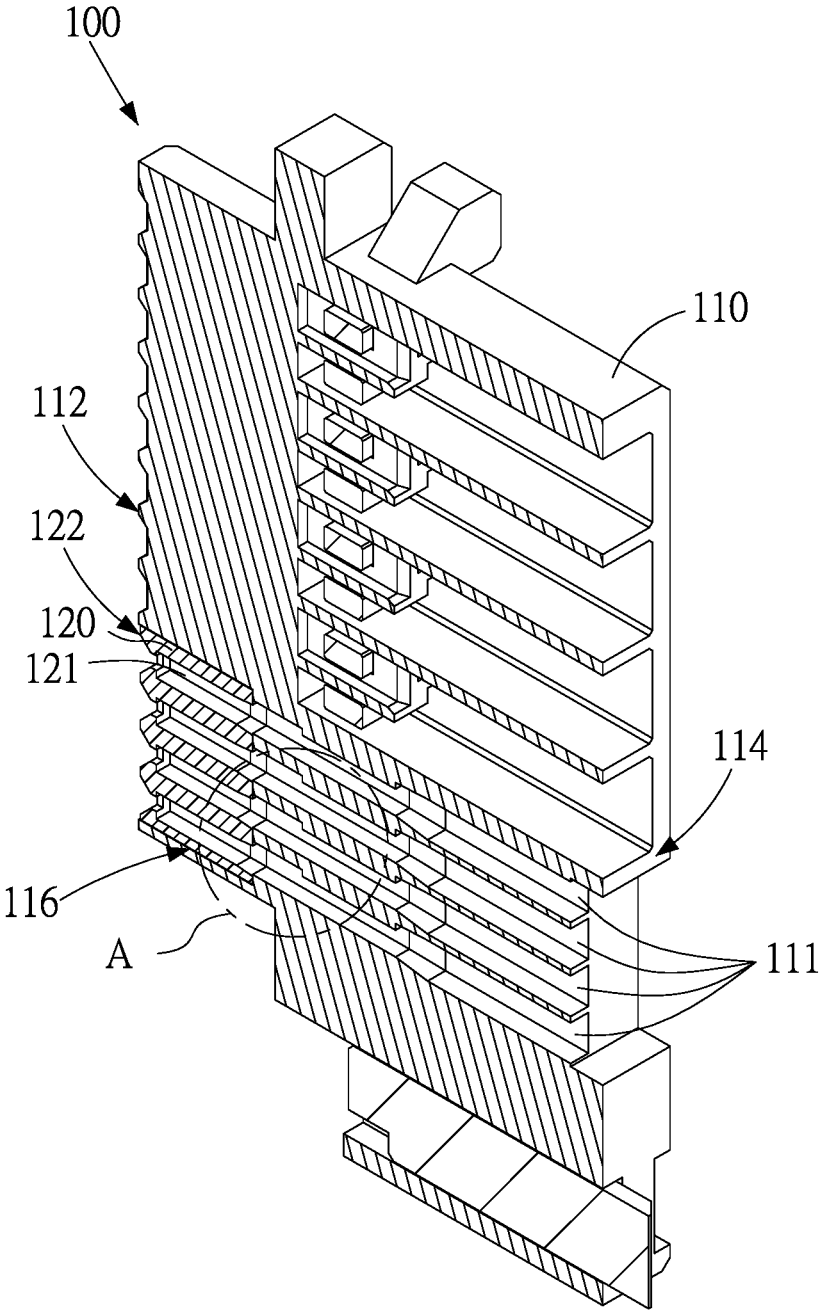
FIG. 4 illustrates a cross-sectional view of the base of the electrical connector of the first embodiment.

As shown in FIGS. 3 and 4, the front cover 120 is embedded into the installation trough 116 with the rear surface 124 facing the body 110, such that the at least one second positioning member 123 combines with the first positioning member 113. Hence, each of the second through holes 121 communicates one corresponding first through hole 111. In particular, each of the second through holes 121 is connected to one corresponding first through hole 111 to form a terminal insertion hole. It is understood that the shape of the cross-sections of the first through hole 111 and the second through hole 121 are not limited, and may be a circle, an ellipse, a rectangle, or other polygonal shapes.

As shown in FIG. 1, in the first embodiment, the first positioning member 113 and the second positioning member 123 are a combination of a protruding portion and a recessed portion. The recessed portion is a trench formed on the inner wall 116*a* of the installation trough 116. One of two ends of the trench is opened at the first side surface 112, and the other end of the trench is extending inward the installation trough 116. The protruding portion is a positioning rib protruding from the outer wall 120*a* of the front cover 120, and the positioning rib can slide into the corresponding trench.

Accordingly, when the front cover 120 is embedded into the installation trough 116, the front cover 120 can enter the installation trough 116 by a correct orientation because the combination of the first positioning member 113 and the second positioning member 123 limit the orientation. Hence, the first through hole 111 can be properly aligned with and connected to the second through hole 121.

Figure 5:
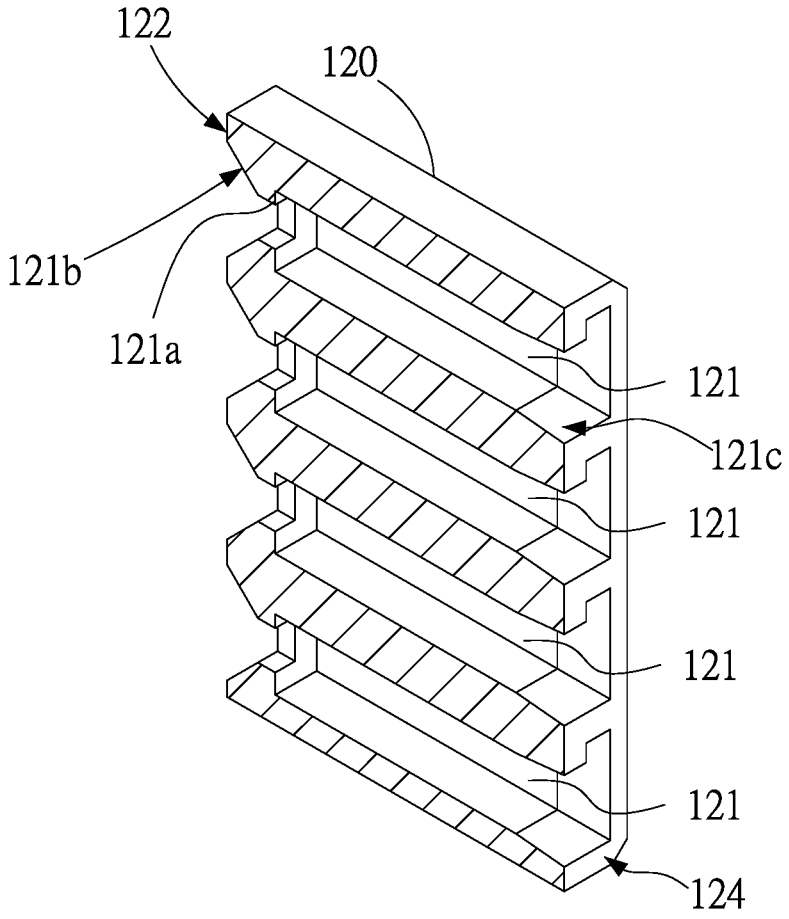
FIG. 5 illustrates a cross-sectional view of a front cover of the electrical connector of the first embodiment.

As shown in FIG. 5, the second through hole 121 at one end of the front surface 122 forms a stopping flange 121*a*. The stopping flange 121*a* is extending inwardly along a radial direction of the second through hole 121. The stopping flange 121*a* may be a portion protruding from the inner wall of the second through hole 121 or may be a structure annularly protruding from the inner wall of the second through hole 121. Therefore, a cross-sectional area of a portion of the second through hole 121 having the stopping flange 121*a* is smaller than a cross-sectional area of a portion of the second through hole 121 not having the stopping flange 121*a*.

Figure 6:
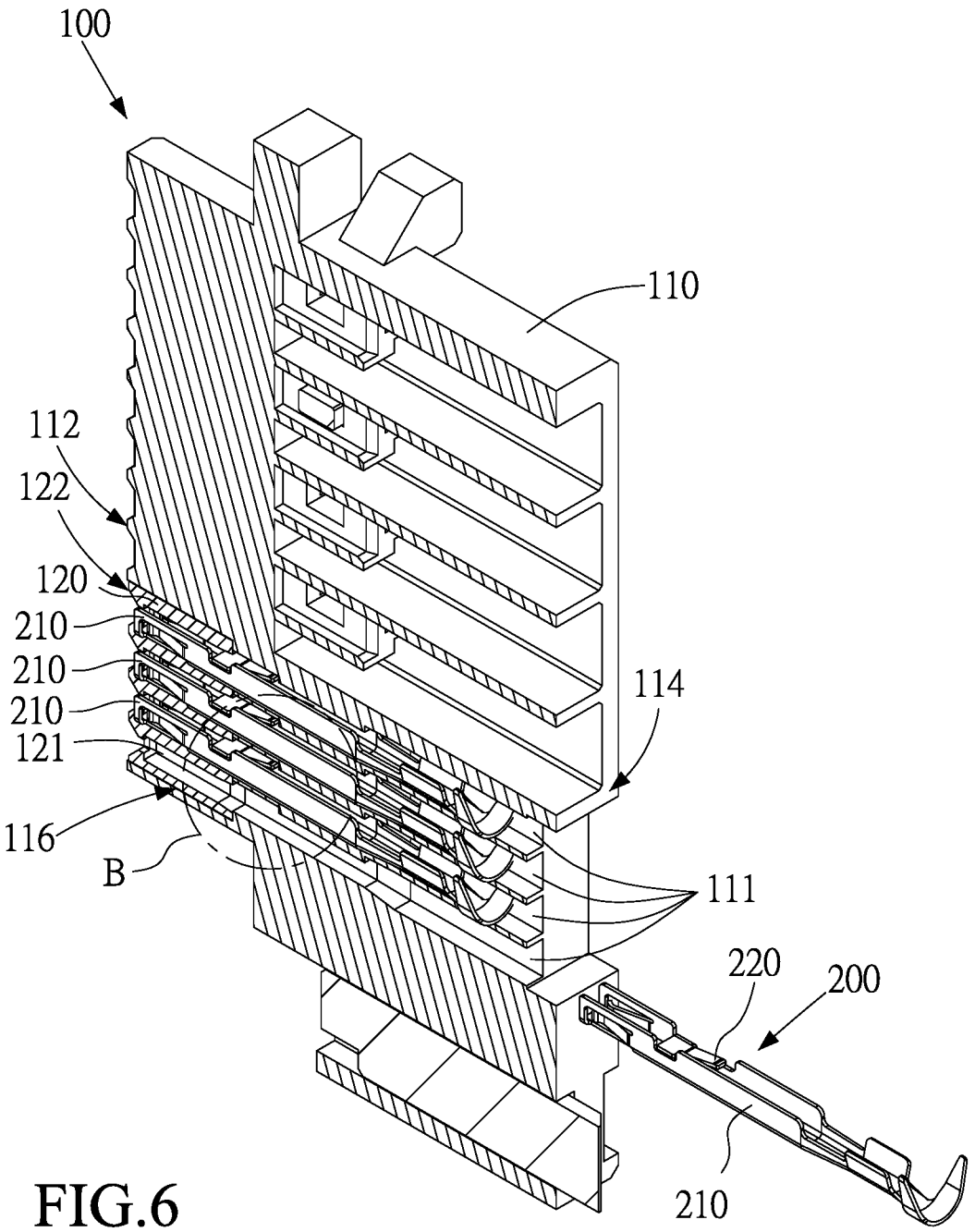
FIG. 6 illustrates an exploded cross-sectional view of the electrical connector of the first embodiment.
Figure 7:
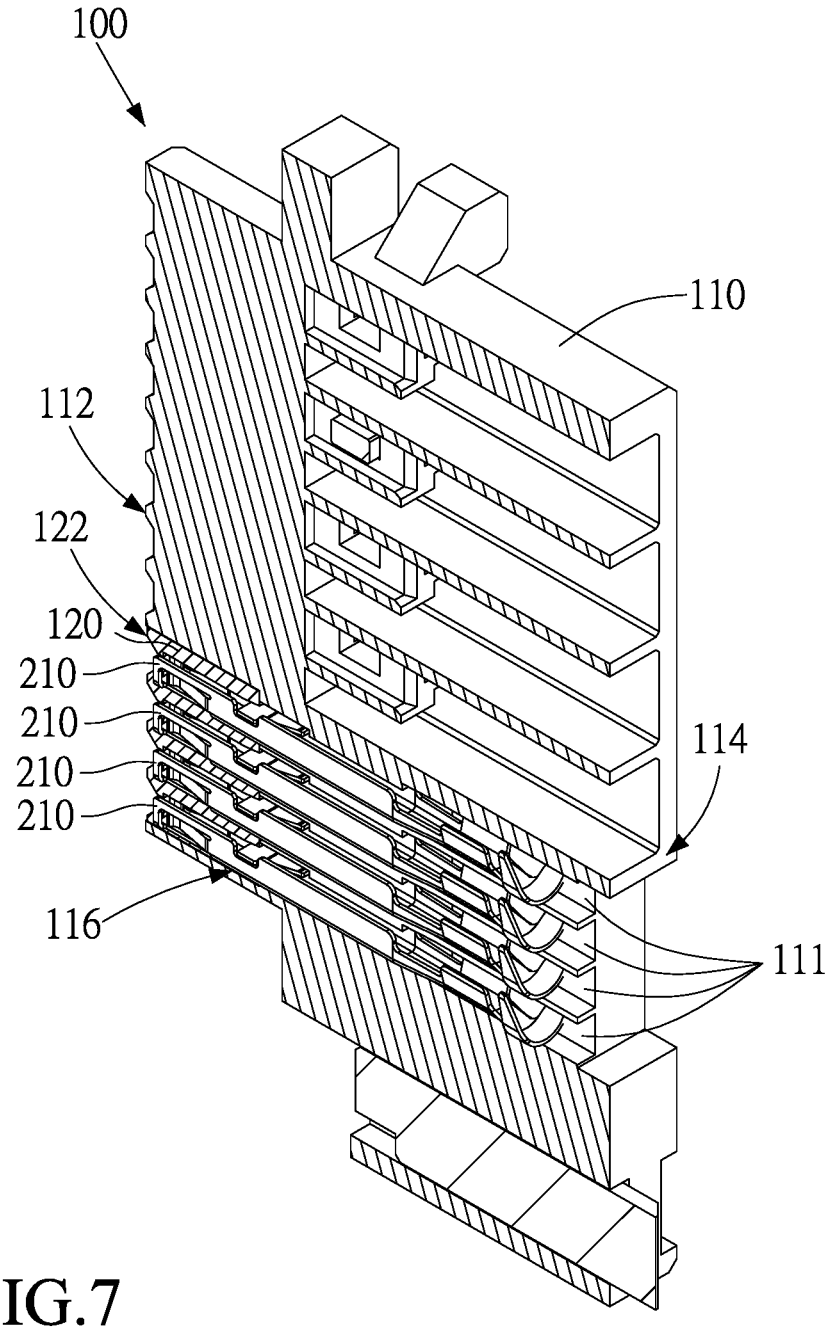
FIG. 7 illustrates a cross-sectional view of the electrical connector of the first embodiment.

As shown in FIGS. 6 and 7, the terminal pin 200 includes a pin body 210 and an elastic latch 220. The elastic latch 220 is connected to the pin body 210 and normally protrudes from the pin body 210. In general, the pin body 210 may be a hollowed circular cylinder or a semicircular-like structure. A length of the pin body 210 is not greater than a summation of a length of the first through hole 111 and a length of the second through hole 121. Namely, in this embodiment, the pin body 210 is received in the terminal insertion hole formed by the combination of the first through hole 111 and the second through hole 121.

As shown in FIGS. 6 and 7, during the assembly process of the base 100, the pin body 210 is inserted into the first through hole 111 and then inserted into the second through hole 121 from the second side surface 114. Accordingly, the pin body 210 is received in the terminal insertion hole formed by the first through hole 111 and the second through hole 121. At the same time, a front end of the pin body 210 is stopped by the stopping flange 121*a* and cannot protrude from the front surface 122 of the front cover 120. Hence, when an external terminal pin is inserted into the pin body 210 or detached from the pin body 210, the pin body 210 is secured by the body 110 and the front cover 120, and the pin body 210 is not moved or is not detached off the base 100 during the plug and unplug operation of the external pin.

As shown in FIG. 5, the front cover 120 further includes a first guiding bevel 121*b*. The first guiding bevel 121*b* is located at the front surface 122 of the front cover 120 and arranged corresponding to the second through hole 121. An opening section of the second through hole 121 corresponding to the front surface 122 has a stepped segment with respect to the front surface 122. And the stepped segment is connected to the front surface 122 and the edge of the opening section through the first guiding bevel 121*b*. The first guiding bevel 121*b* may be a single conical surface or may be formed by plural planes, so that a tapped cone hole is formed on the front surface 122 and connected to the second through hole 121. The first guiding bevel 121*b* is provided for guiding the external terminal pin to enter into the second through hole 121. Hence, the terminal pin is not required to be precisely aligned with the second through hole 121 having a relative smaller pore size.

Figure 8:
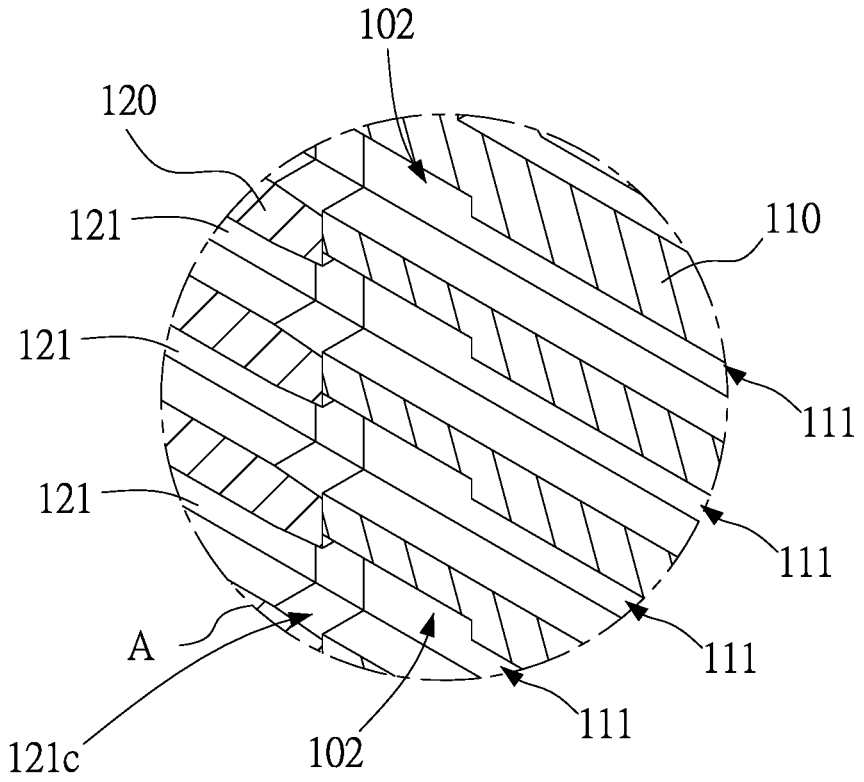
FIG. 8 illustrates an enlarged view of the portion A shown in FIG. 4.

As shown in FIG. 8, the front cover 120 further includes a second guiding bevel 121*c*. The second guiding bevel 121*c* is located at the rear surface 124 of the front cover 120 and arranged corresponding to the second through hole 121. Similarly, the second guiding bevel 121*c* may be a single conical surface or may be formed by plural planes, so that a tapped cone hole can be formed on the rear surface 124 and connected to the second through hole 121. The second guiding bevel 121*c* is provided for guiding the pin body 210 of the terminal pin 200, so that a portion of the terminal pin 200 located in the installation trough 116 can be inserted into the second through hole 121 smoothly.

As shown in FIG. 2, the body 110 further includes a third guiding bevel 118. The third guiding bevel 118 is located at a middle portion of the first through hole 111. The third guiding bevel 118 may be a single conical surface or may be formed by plural planes. The third guiding bevel 118 divides the first through hole 111 into two portions. A pore diameter of one of the two portions of the first through hole 111 near the second side surface 114 is greater than a pore diameter of the other portion of the first through hole 111 near the first side surface 112. Hence, the terminal pin 200 can be inserted into the first through hole 111 easily from the second side surface 114, while the terminal pin 200 can be properly limited by the first through hole 111 without excessive lateral deflection movements.

Figure 9:
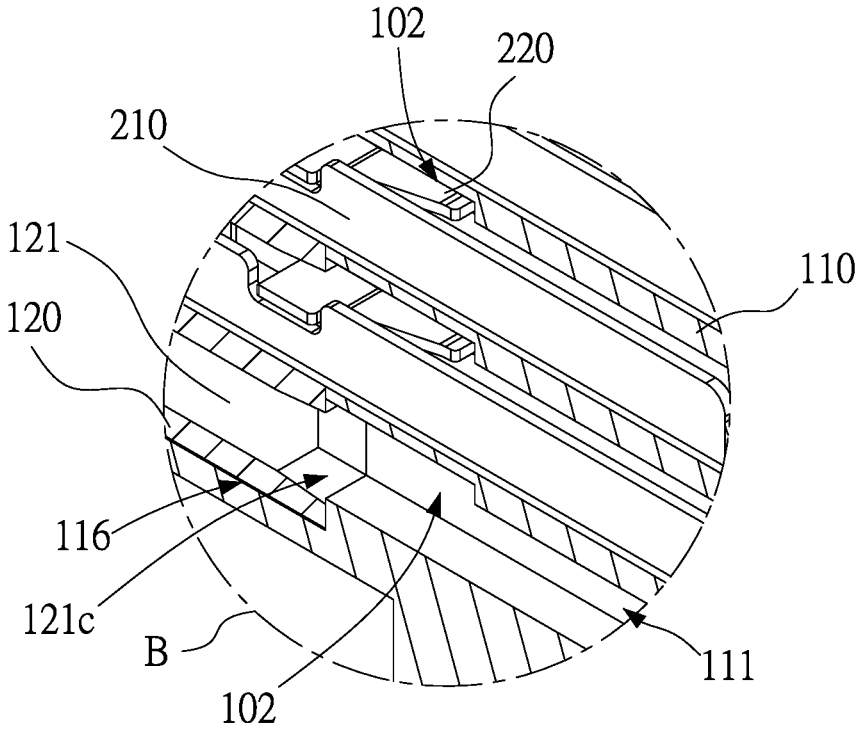
FIG. 9 illustrates an enlarged view of the portion B shown in FIG. 6.

As shown in FIGS. 8 and 9, a notch 102 is formed in the terminal insertion hole formed by the first through hole 111 and the second through hole 121, and the notch 102 is recessed from an inner wall of the terminal insertion hole.

Figure 10:
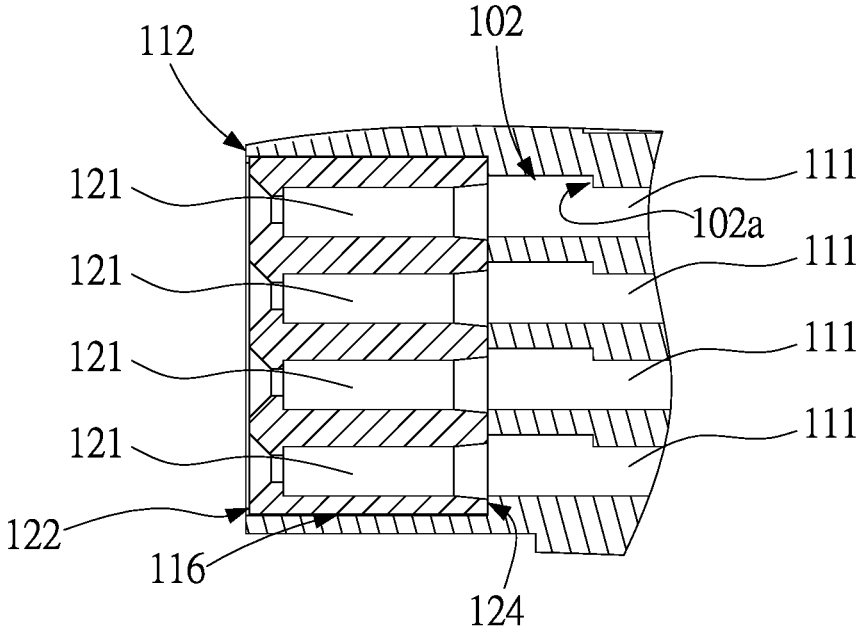
FIG. 10 illustrates a partial cross-sectional view of the base of the electrical connector of the first embodiment.
Figure 11:
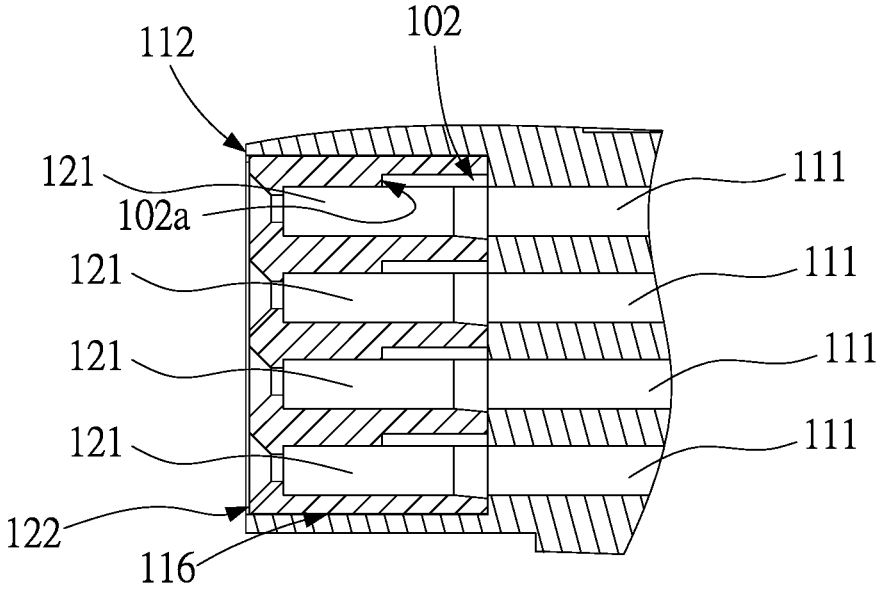
FIG. 11 illustrates another partial cross-sectional view of the base of the electrical connector of the first embodiment.

Please refer to FIGS. 10 and 11. The notch 102 may be formed on an inner wall of the first through hole 111, on an inner wall of the second through hole 121, or on a connection portion between the first through hole 111 and the second through hole 121. As shown in FIG. 10, an opening section of the first through hole 111 at the installation trough 116 forms a unfilled corner 102*a*; thus, when the body 110 is combined with the front cover 120, the front cover 120 encloses an open side of the unfilled corner 102*a* to form the notch 102. As shown in FIG. 11, an opening section of the second through hole 121 at the rear surface 124 forms a unfilled corner 102*a*; thus, when the body 110 is combined with the front cover 120, the front cover 120 encloses an open side of the unfilled corner 102*a* to form the notch 102. It is understood, the notch 102 may be directly formed on the inner wall of the first through hole 111 or on the inner wall of the second through hole 121.

When the pin body 210 is inserted into the terminal insertion hole, the elastic latch 220 is abutted against an inner wall of the terminal insertion hole and closely attached on the surface of the pin body 210. When the front end of the pin body 210 is stopped by the stopping flange 121*a*, the elastic latch 220 is located in the notch 102, and the elastic latch 220 recovers to a protruding configuration and is engaged into the notch 102. Therefore, the pin body 210 cannot be detached from the second side surface 114 of the body 110, thereby achieving the positioning for the terminal pin 200.

Accordingly, the terminal insertion hole with a relative complicated structure can be formed by the combination of the body 110 and the front cover 120, thereby facilitating in positioning the terminal pin 200 in the base 100 without additional fixing elements, such as fixing pins. Accordingly, the assembly procedure for the electrical connector having the base 100 is significantly simplified.

Figure 12:
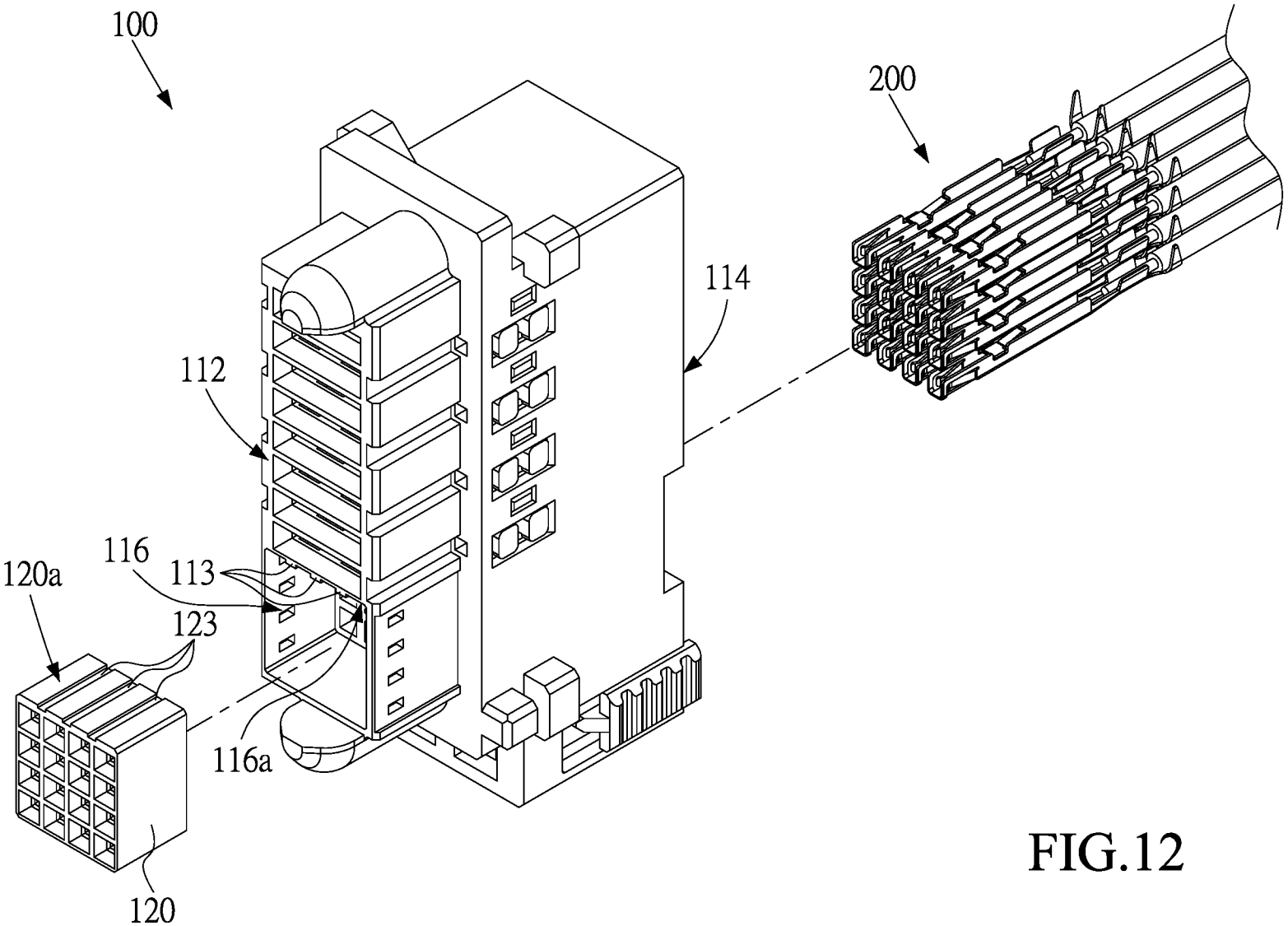
FIG. 12 illustrates an exploded view of a base of an electrical connector according to a second embodiment of this disclosure.

Please refer to FIG. 12, illustrating a base 100 of an electrical connector according to a second embodiment of this disclosure. The base 100 comprises a body 110 and a front cover 120. In the second embodiment, similarly, the first positioning member 113 and the second positioning member 123 are a combination of a protruding portion and a recessed portion. The recessed portion is a trench formed on the outer wall 120*a* of the front cover 120. One of two ends of the trench is opened at the rear surface 124, and the other end of the trench is extending toward the front surface 122. The protruding portion is a positioning rib protruding from the inner wall 116*a* of the installation trough 116.

Figure 13:
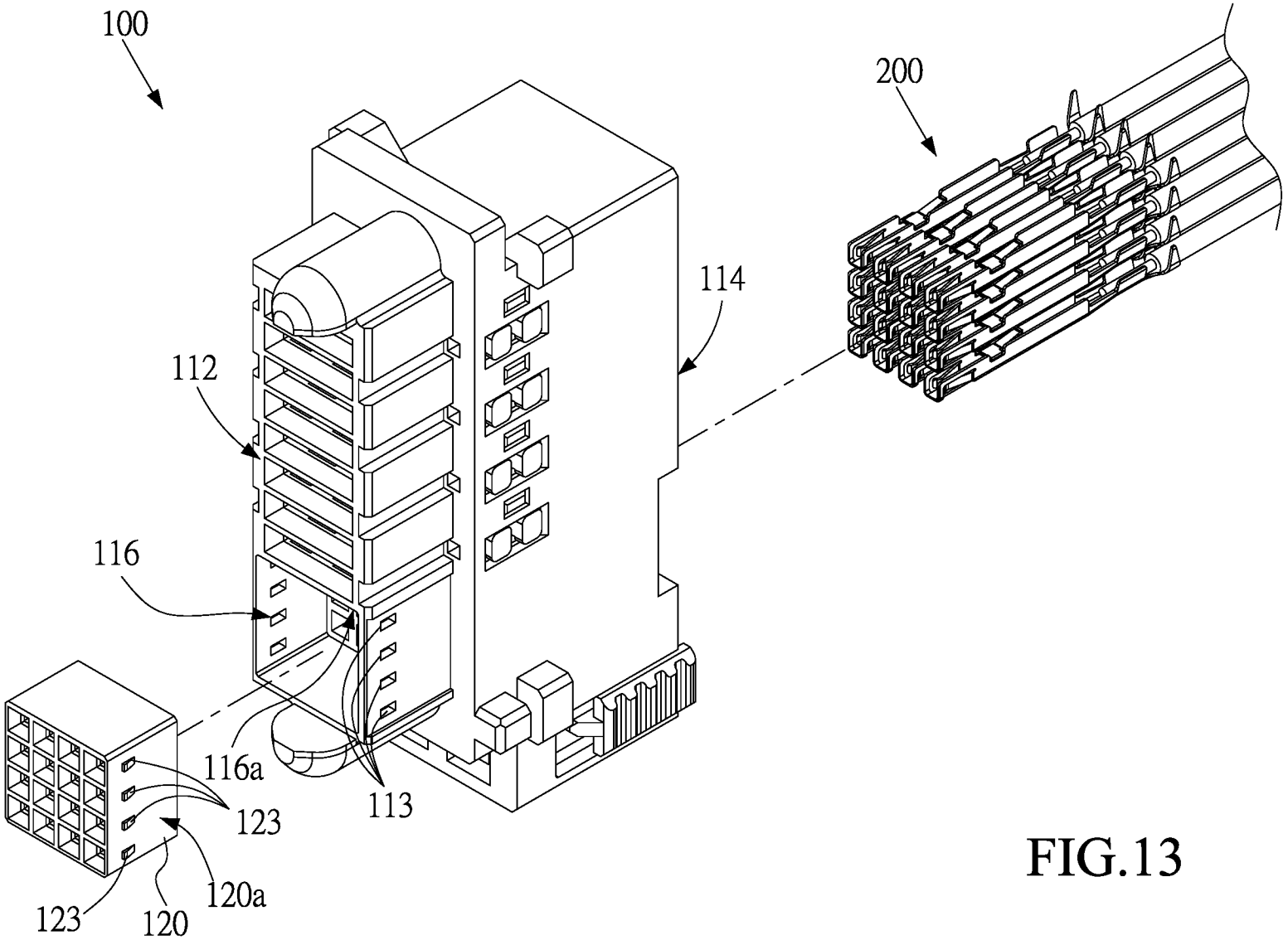
FIG. 13 illustrates an exploded view of a base of an electrical connector according to a third embodiment of this disclosure.

Please refer to FIG. 13, illustrating a base 100 of an electrical connector according to a third embodiment of this disclosure. The base 100 comprises a body 110 and a front cover 120. In the third embodiment, similarly, the first positioning member 113 and the second positioning member 123 are a combination of a protruding portion and a recessed portion. Specifically, in this embodiment, the protruding portion is a latch member and the recessed portion is a latch hole. In the third embodiment, the latch member is formed on the outer wall 120*a* of the front cover 120, the latch hole is located on the inner wall 116*a* of the installation trough 116. The latch hole may be in communication with or not in communication with the outer wall of the body 110. As shown in FIG. 10, by engaging the latch member into the latch hole, the assembly direction for the front cover 120 can be limited, thereby firmly positioning the front cover 120 on the body 110. In the third embodiment, the latch member may be formed on the inner wall 116*a* of the installation trough 116, and the latch hole is recessed from the outer wall 120*a* of the front cover 120.

Figure 14:
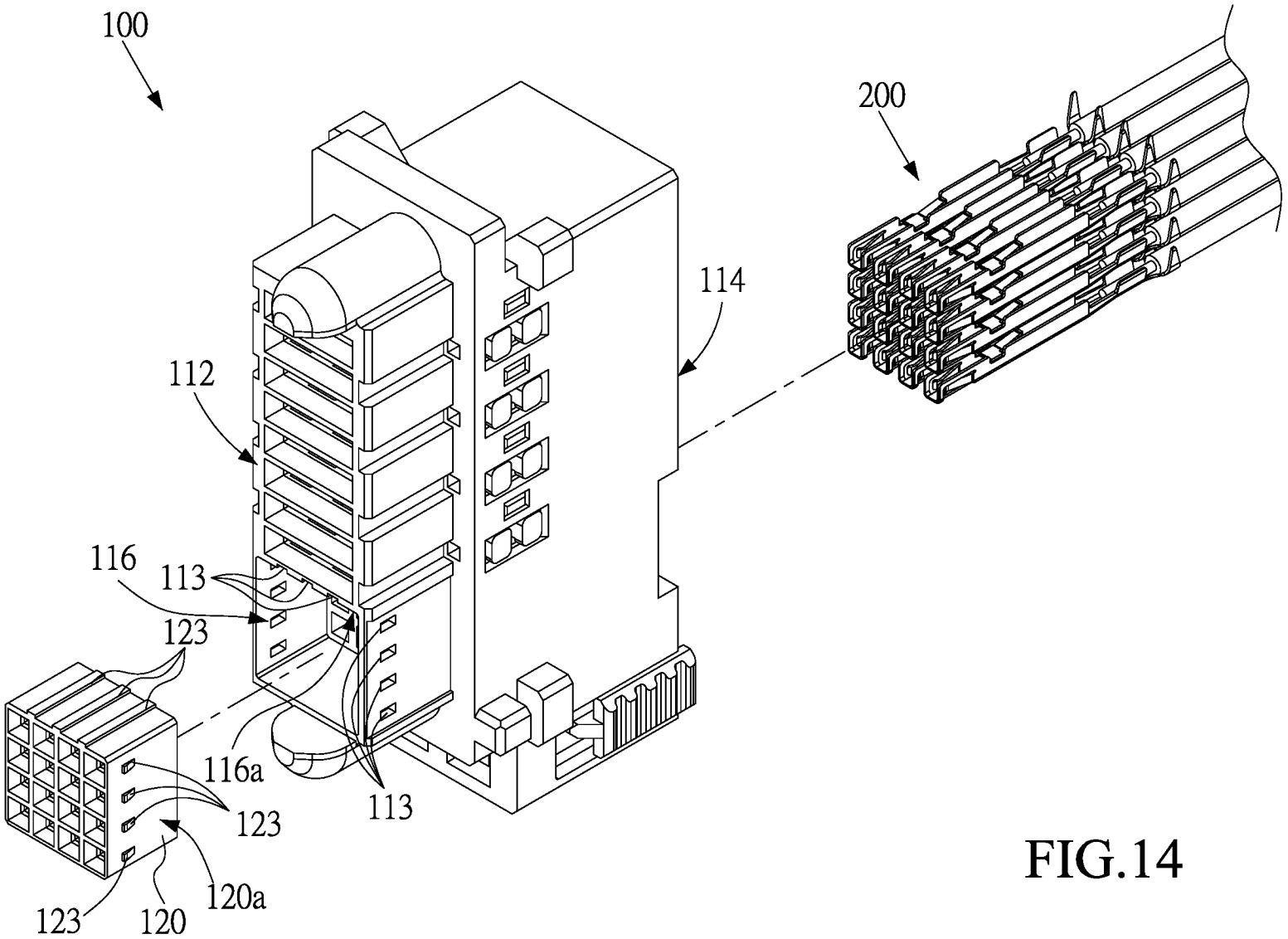
FIG. 14 illustrates an exploded view of a base of an electrical connector according to a fourth embodiment of this disclosure.

Please refer to FIG. 14, illustrating a base 100 of an electrical connector according to a fourth embodiment of this disclosure. The base 100 comprises a body 110 and a front cover 120. In the fourth embodiment, similarly, the first positioning member 113 and the second positioning member 123 are a combination of a protruding portion and a recessed portion. Moreover, the combination of the protruding portion and the recessed portion may be a combination of the combination of the positioning rib and the trench and the combination of the latch member and the latch hole.

Figure 15:
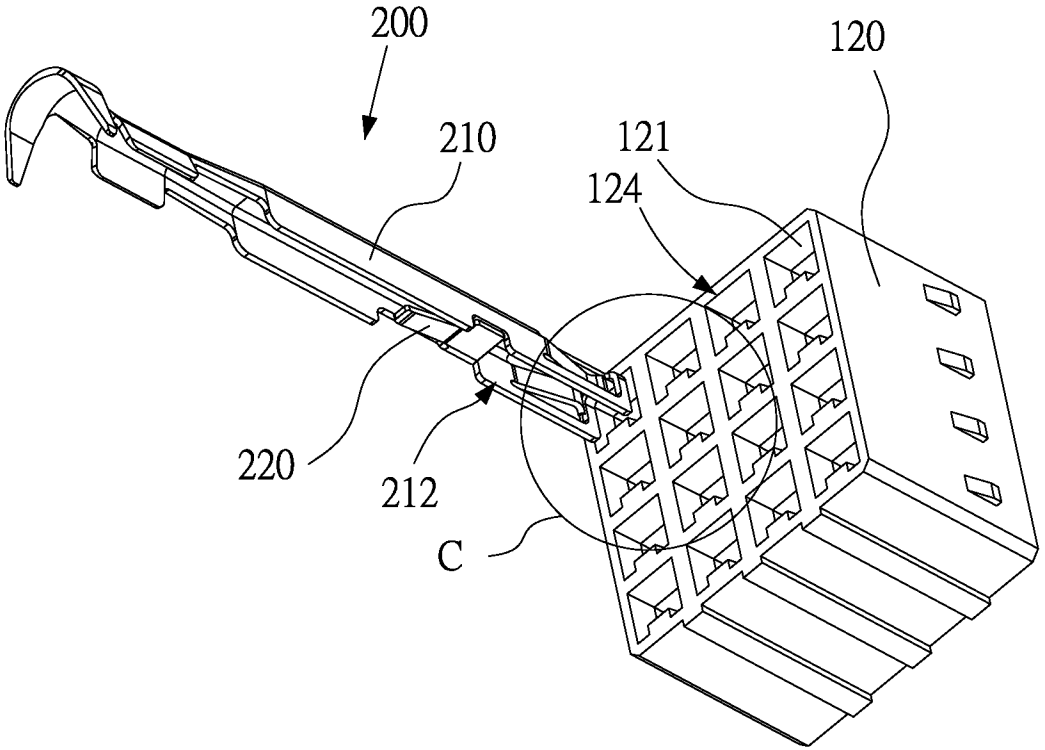
FIG. 15 illustrates a partial exploded view of a front cover and a terminal pin of an electrical connector according to a fifth embodiment of this disclosure, where a partial cross-sectional view of the front cover is illustrated.
Figure 17:
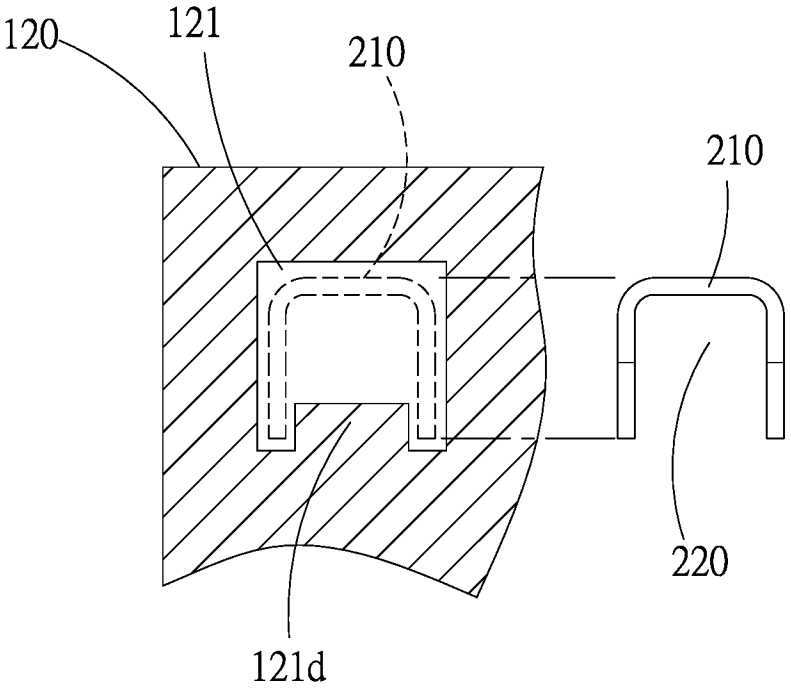
FIG. 17 illustrates a partial cross-sectional view of the front cover and the terminal pin of the electrical connector of the fifth embodiment.
Figure 16:
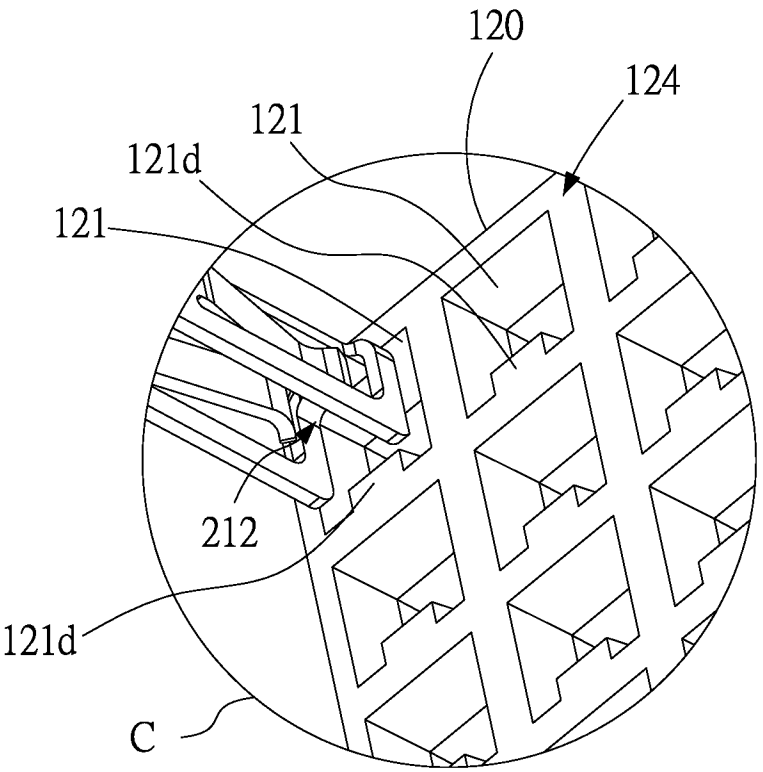
FIG. 16 illustrates an enlarged view of the portion C shown in FIG. 15.

Please refer to FIGS. 15, 16, and 17, a front cover 120 of a base 100 of an electrical connector according to a fifth embodiment of this disclosure is illustrated. The front cover 120 is adapted to be combined with the body 110 and the terminal pin 200 to from an electrical connector.

As shown in FIGS. 15 and 17, in the fifth embodiment, one side of the pin body 210 is opened to form a concave portion 212. A root portion of the elastic latch 220 is configured across the concave portion 212 and protruding above the concave portion 212. Under this configuration, the assembly of the terminal pin 200 may have orientation requirements. In other words, in this embodiment, the concave portion 212 may have to face a certain direction to allow the elastic latch 220 engaging into the notch 102.

As shown in FIGS. 15, 16, and 17, a protruding rib 121*d* is disposed in the second through hole 121 and extending along a longitudinal direction of the second through hole 121, and the protruding rib 121*d* is arranged corresponding to the concave portion 212 of the pin body 210. Therefore, in this embodiment, when the pin body 210 is inserted into the second through hole 121, the concave portion 212 has to be aligned with the protruding rib 121*d*, so that the protruding rib 121*d* is received in the concave portion 212, thereby forcing the concave portion 212 to face to the certain direction.

Figure 18:
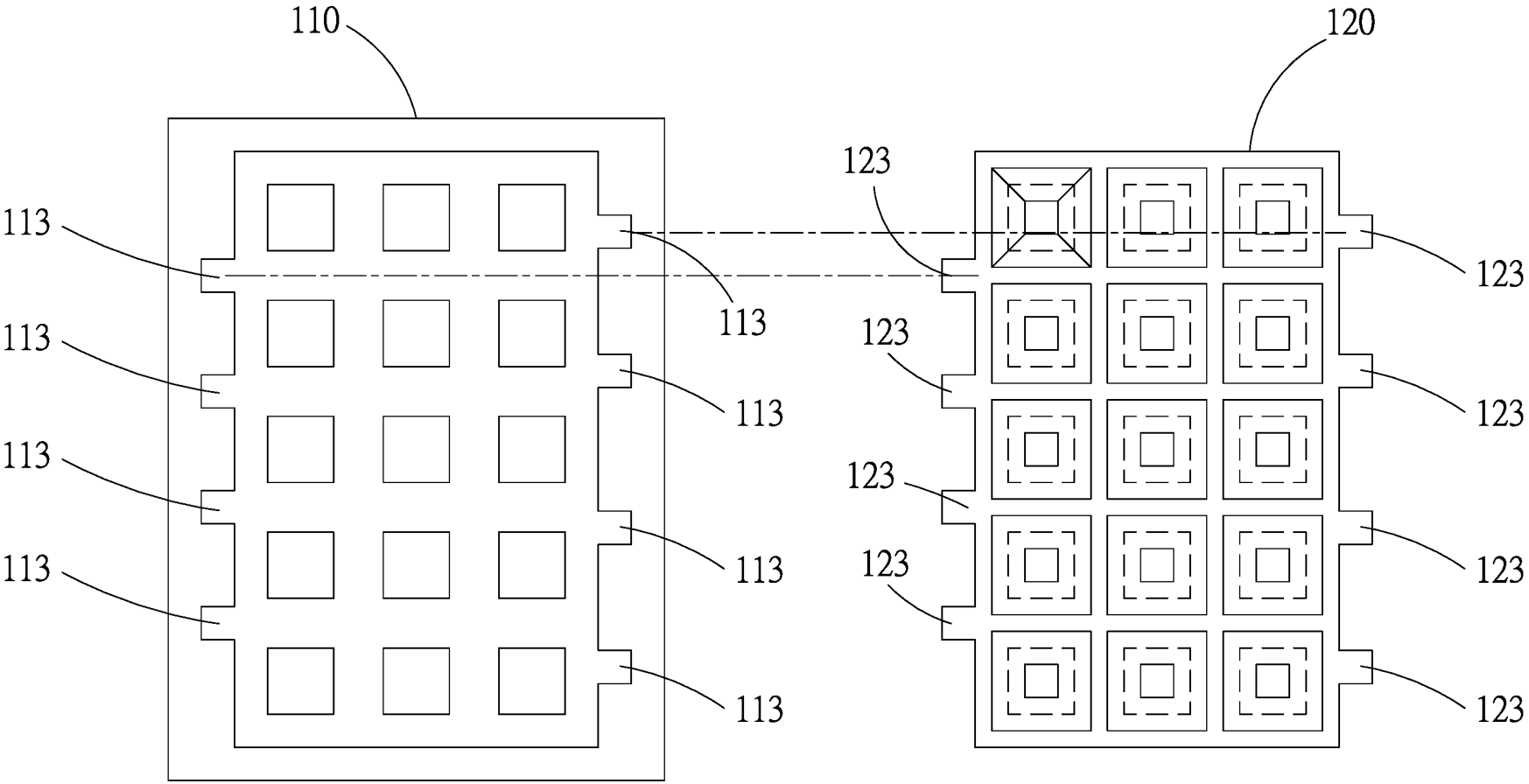
FIGS. 18 to 23 illustrate front views of the front cover in different configurations, where the configurations of the second positioning members are different.
Figure 19:
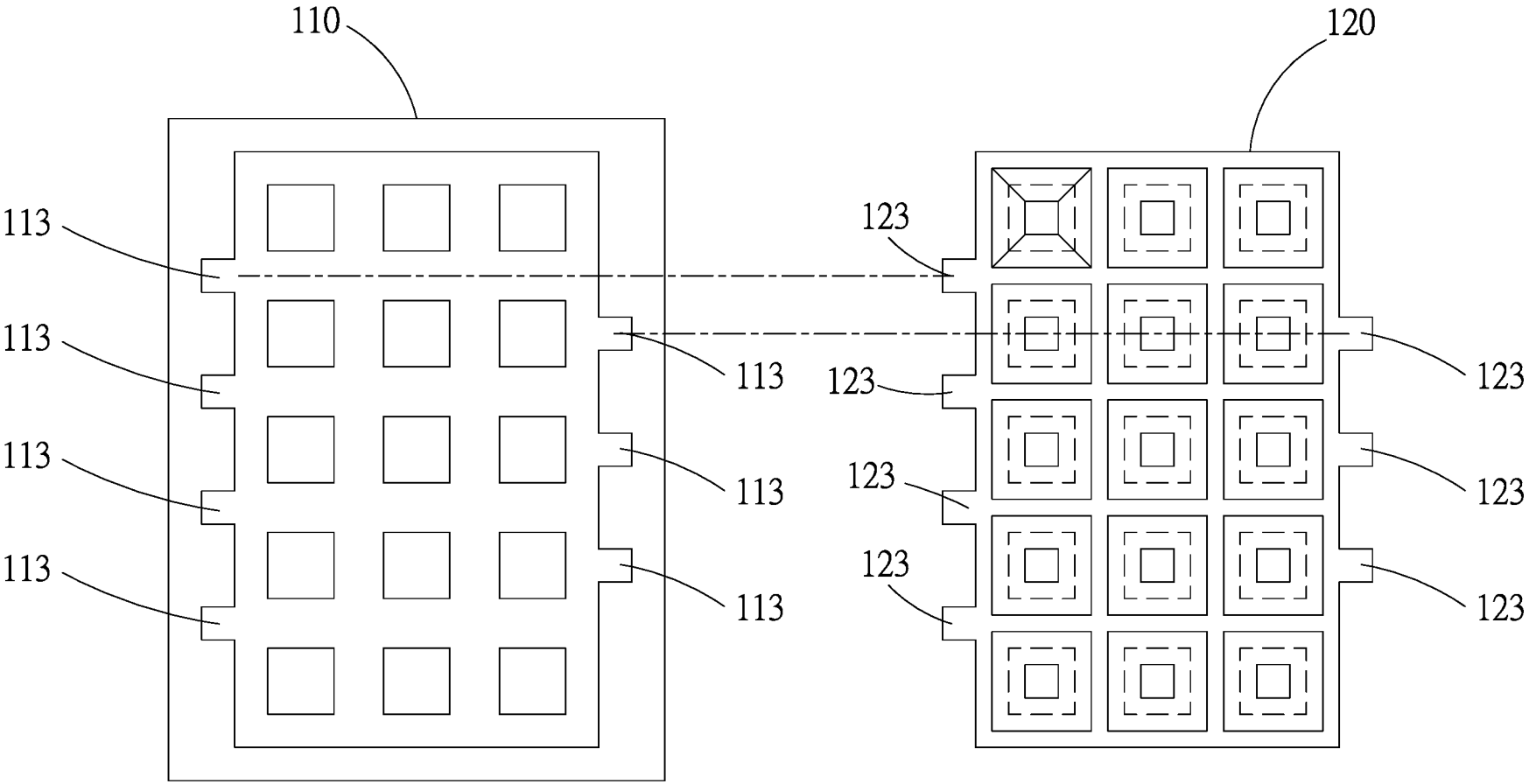
Figure 20:
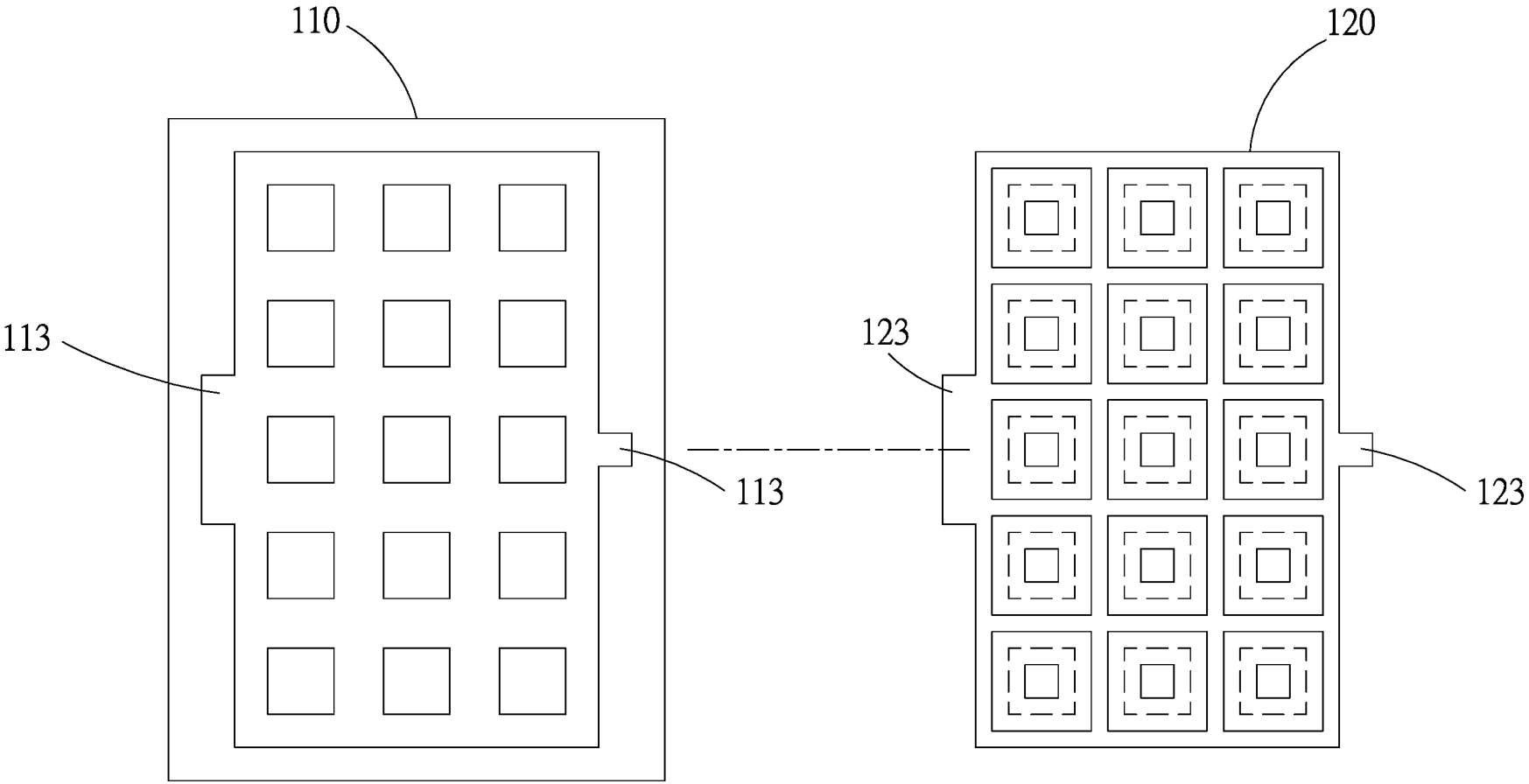

As shown in FIGS. 18, 19, and 20, in embodiments having plural second positioning members 123, the relative positions of the second positioning members 123 after the front cover 120 is rotated about the longitudinal direction and the relative positions of the second positioning members 123 before the front cover 120 is rotated cannot be substantially the same. In other words, unless the front cover 120 is rotated by 360 degrees, no matter what the rotation angle is the relative positions of the second positioning members 123 before and after the front cover is rotated about the longitudinal direction should not be the same. Hence, an incorrect positioning can be avoided in which the front cover 120 is embedded into the installation trough 116 with an incorrect angle.

As shown in FIG. 18, in the case that a plurality of second positioning members 123 are respectively disposed on two opposite outer side surfaces of the front cover 120, in this embodiment, the second positioning members 123 on the two opposite outer side surfaces of the front cover 120 are arranged in misalignment. Hence, when the front cover 120 is rotated about the longitudinal direction by 180 degrees, the relative positions of the second positioning members 123 before and after the front cover 120 is rotated are not the same.

As shown in FIG. 19, a number of the second positioning members 123 on one of the two outer side surfaces of the front cover 120 is different from a number of the second positioning members 123 on the other outer side surface of the front cover 120. Under this configuration, a condition that the relative positions of the second positioning members 123 before and after the front cover 120 is rotated being substantially the same can be avoided effectively.

As shown in FIG. 20, in another configuration, geometrical configurations of the second positioning members 123 on one of the two outer side surfaces of the front cover 120 is different from geometrical configurations of the second positioning members 123 on the other outer side surface of the front cover 120. The geometrical configurations include the shape of the cross section of the second positioning member 123 and the size of the second positioning member 123.

Figure 21:
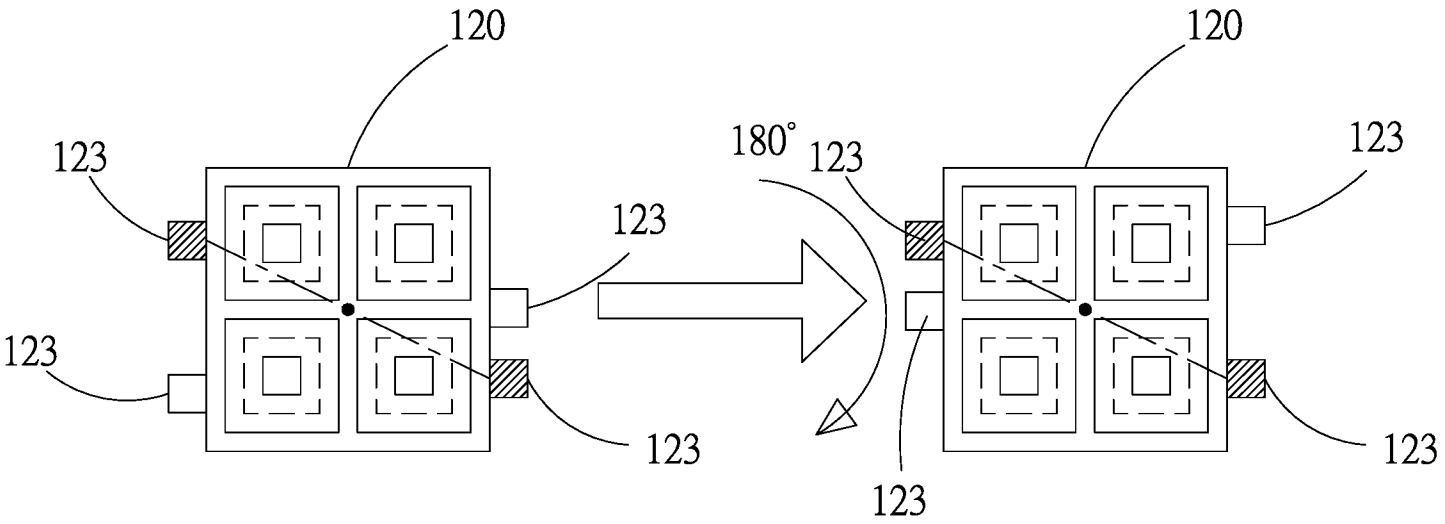
Figure 22:
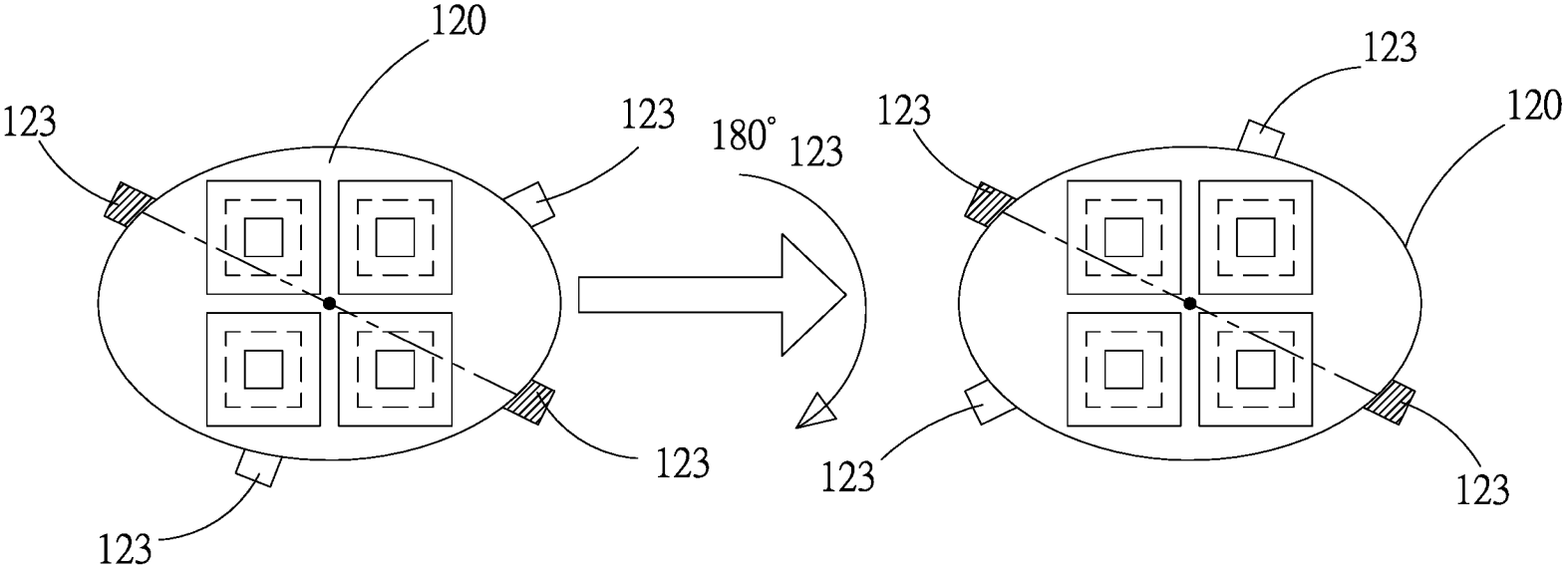
Figure 23:
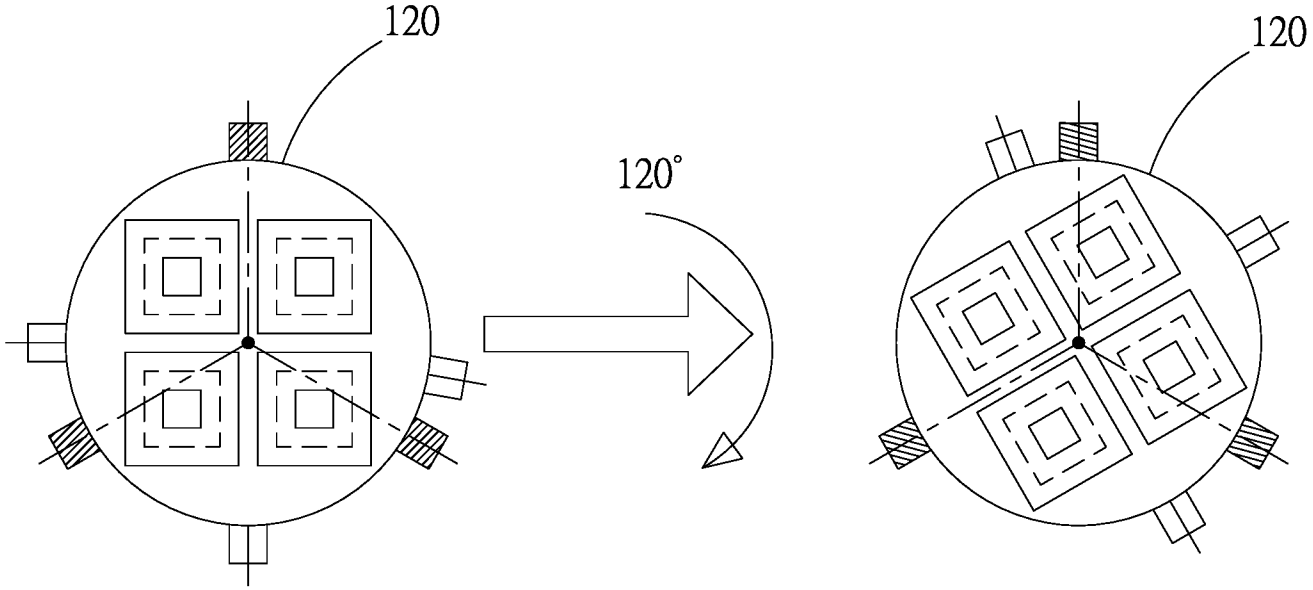

As shown in FIGS. 21, 22, and 23, when the a shape of a cross section of the front cover 120 is squared, circular, oval, rectangular, or other shapes having axial symmetric or radial symmetric configurations, the arrangement of the second positioning members 123 has a non-radial configuration. Therefore, the relative positions of the second positioning members 123 before and after the front cover 120 is rotated are not the same.

As shown in FIGS. 21 and 22, when the number of the second positioning members 123 is two, a connection line between the two second positioning members 123 should not pass through a centroid of the cross section of the front cover 120, as the two second positioning members 123 without profile lines shown in the figure. If the two second positioning members 123 are configured as the two second positioning members 123 with profile lines shown in the figure, the relative positions of the second positioning members 123 before and after the front cover 120 is rotated are the same when the front cover 120 is rotated about the long axis direction by 180 degrees, thereby resulting in the incorrect orientation during the assembly process of the front cover 120 on the body 110.

As shown in FIG. 23, when the number of the second positioning members 123 is three or more, a radial symmetric configuration for the second positioning members 123 should also be avoided. For example, in the case that a center of gravity of three second positioning members 123 substantially overlaps the centroid of the cross section of the front cover 120, when the front cover 120 is rotated about the longitudinal direction by 120 degrees, the relative positions of the second positioning members 123 before and after the front cover 120 is rotated, as the three second positioning members 123 with profile lines shown in the figure, are substantially the same, thereby resulting in the incorrect positioning when assembling the front cover 120 on the body 110. Hence, the position of at least one second positioning member 123 has to be adjusted to make the center of gravity of the three second positioning members 123 not overlap the centroid or to configure the three second positioning members 123 in a non-radial configuration, as the three second positioning members 123 without profile lines shown in the figure. Accordingly, a condition that the relative positions for the rotated second positioning members 123 and not-rotated second positioning members 123 being substantially the same can be avoided.

What is claimed is:

1. A base of an electrical connector, comprising:

a body, including a first side surface, a second side surface and a third guiding bevel; wherein an installation trough is formed on the first side surface, the body further includes at least one first through hole communicating the second side surface and the installation trough, at least one first positioning member is disposed on an inner wall of the installation trough, the third guiding bevel is located at a middle portion of the first through hole, and the third guiding bevel divides the first through hole into two sections, a pore diameter of one of the two sections of the first through hole near the second side surface is greater than a pore diameter of the other section of the first through hole near the first side surface; and a front cover, including a front surface, a rear surface and at least one second through hole communicating the front surface and the rear surface; wherein at least one second positioning member is disposed an outer wall of the front cover for combining with the first positioning member, and the front cover is embedded into the installation trough with the rear surface facing the body, such that the at least one second positioning member combines with the at least one first positioning member, and the second through hole communicates the first through hole.

2. The base of the electrical connector as claimed in claim 1, wherein the second through hole at one end of the front surface forms a stopping flange, extending inwardly along a radial direction of the second through hole.

3. The base of the electrical connector as claimed in claim 1, wherein the front cover further includes a first guiding bevel located at the front surface of the front cover and corresponding to the second through hole.

4. The base of the electrical connector as claimed in claim 1, wherein the front cover further includes a second guiding bevel located at the rear surface of the front cover and corresponding to the second through hole.

5. The base of the electrical connector as claimed in claim 1, wherein the front cover includes a plurality of second positioning members respectively disposed on two opposite outer side surfaces of the front cover, and the second positioning members on the two opposite outer side surfaces are arranged in misalignment.

6. The base of the electrical connector as claimed in claim 1, wherein the front cover includes a plurality of second positioning members respectively disposed on two opposite outer side surfaces of the front cover, and a number of the second positioning members on one of the two outer side surfaces of the front cover is different from a number of the second positioning members on the other outer side surface of the front cover.

7. The base of the electrical connector as claimed in claim 1, wherein the front cover includes a plurality of second positioning members respectively disposed on two opposite outer side surfaces of the front cover, and geometrical configurations of the second positioning members on one of the two outer side surfaces of the front cover is different from geometrical configurations of the second positioning members on the other outer side surface of the front cover.

8. The base of the electrical connector as claimed in claim 1, wherein a shape of a cross section of the front cover is axial symmetric or radial symmetric, the front cover includes a plurality of second positioning members, and a center of gravity of the second positioning members does not pass through a centroid of the cross section of the front cover.

9. The base of the electrical connector as claimed in claim 1, wherein a protruding rib is disposed in the second through hole and extending along a longitudinal direction of the second through hole.

10. The base of the electrical connector as claimed in claim 1, wherein the first positioning member and the second positioning member are a combination of a protruding portion and a recessed portion.

11. The base of the electrical connector as claimed in claim 10, wherein the recessed portion is a trench and the protruding portion is a positioning rib.

12. The base of the electrical connector as claimed in claim 2, wherein the protruding portion is a latch member, and the recessed portion is a latch hole.

13. The base of the electrical connector as claimed in claim 1, wherein the second through holes is connected to the corresponding first through hole to form a terminal insertion hole, a notch is formed in the terminal insertion hole, and the notch is recessed from an inner wall of the terminal insertion hole.

14. The base of the electrical connector as claimed in claim 13, wherein the notch is on an inner wall of the first through hole, on an inner wall of the second through hole, or on a connection portion between the first through hole and the second through hole.

15. An electrical connector, comprising:

a base of the electrical connector according to claim 1; and a terminal pin, including a pin body received in a terminal insertion hole formed by the first through hole and the second through hole.

16. The electrical connector as claimed in claim 15, wherein a length of the pin body is not greater than a summation of a length of the first through hole and a length of the second through hole.

17. The electrical connector as claimed in claim 15, wherein one side of the pin body is opened to form a concave portion, a protruding rib is disposed in the second through hole and extending along a longitudinal direction of the second through hole, and the protruding rib is received in the concave portion.

18. The electrical connector as claimed in claim 15, wherein a notch is formed in the terminal insertion hole, the notch is recessed from an inner wall of the terminal insertion hole, the terminal pin further includes an elastic latch, the elastic latch is connected to the pin body, and the elastic latch normally protrudes from the pin body and is engaged into the notch.

19. The electrical connector as claimed in claim 18, wherein the notch is on an inner wall of the first through hole, on an inner wall of the second through hole, or on a connection portion between the first through hole and the second through hole.

* * * * *